US010844677B2

(12) United States Patent
Hansen

(10) Patent No.: US 10,844,677 B2
(45) Date of Patent: Nov. 24, 2020

(54) DOWNHOLE CUTTING TOOL AND METHOD OF USE

(71) Applicant: ARDYNE HOLDINGS LIMITED, Aberdeen (GB)

(72) Inventor: Steffen Hansen, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 96 days.

(21) Appl. No.: 16/329,109

(22) PCT Filed: Sep. 6, 2017

(86) PCT No.: PCT/GB2017/052588
§ 371 (c)(1),
(2) Date: Feb. 27, 2019

(87) PCT Pub. No.: WO2018/046907
PCT Pub. Date: Mar. 15, 2018

(65) Prior Publication Data

US 2019/0226294 A1 Jul. 25, 2019

(30) Foreign Application Priority Data

Sep. 7, 2016 (GB) ..... 1615222.5

(51) Int. Cl.
*E21B 29/00* (2006.01)
*E21B 23/04* (2006.01)
*E21B 10/32* (2006.01)

(52) U.S. Cl.
CPC ..... *E21B 23/04* (2013.01); *E21B 10/322* (2013.01); *E21B 29/005* (2013.01)

(58) Field of Classification Search
CPC ..... E21B 29/00; E21B 29/002; E21B 29/005; E21B 23/04; E21B 10/322; E21B 10/32; E21B 10/325; E21B 10/345
See application file for complete search history.

(56) References Cited

U.S. PATENT DOCUMENTS 3,425,500 A 2/1969 Fuchs
6,131,675 A 10/2000 Anderson
6,289,999 B1 9/2001 Dewey et al.
(Continued)

FOREIGN PATENT DOCUMENTS

GB 2543410 A 4/2017
WO 2015114407 A1 8/2015
(Continued)

OTHER PUBLICATIONS

International Search Report dated Mar. 15, 2018 for PCT/GB2017/052588.

*Primary Examiner* — Brad Harcourt
(74) *Attorney, Agent, or Firm* — Law Office of Jesse D. Lambert, LLC

(57) ABSTRACT

A downhole cutting tool and method of operating the cutting tool. The cutting tool (10) has first and second flow pathways through the tool body (12) and a switching mechanism operated by axial force via weight-set or drop ball to control the opening of the flow pathways and direct fluid to the second flow path and operate the cutting mechanism (18). Fluid flow through the first pathway can be used to actuate a hydraulically operated tool mounted on the tool string below the cutting tool (10).

20 Claims, 7 Drawing Sheets

(56) References Cited

U.S. PATENT DOCUMENTS

| | | | | |
|---|---|---|---|---|
| 6,378,632 | B1 | 4/2002 | Dewey et al. | |
| 2003/0079913 | A1 | 5/2003 | Eppink et al. | |
| 2003/0155155 | A1 | 8/2003 | Dewey et al. | |
| 2004/0065479 | A1 | 4/2004 | Fanuel et al. | |
| 2007/0163809 | A1 | 7/2007 | Mackay et al. | |
| 2008/0041587 | A1 | 2/2008 | Bell et al. | |
| 2009/0126936 | A1 | 5/2009 | Begley et al. | |
| 2009/0223716 | A1 | 9/2009 | Eppink | |
| 2010/0018779 | A1 | 1/2010 | Makkar et al. | |
| 2010/0089583 | A1 | 4/2010 | Xu et al. | |
| 2010/0193250 | A1 | 8/2010 | Graf | |
| 2010/0276201 | A1 | 11/2010 | Makkar et al. | |
| 2011/0127044 | A1 | 6/2011 | Radford et al. | |
| 2011/0232969 | A1 | 9/2011 | Laird et al. | |
| 2011/0284233 | A1* | 11/2011 | Wu ..... | E21B 34/06 166/321 |
| 2012/0111579 | A1 | 5/2012 | Radford et al. | |
| 2012/0298423 | A1 | 11/2012 | Cruickshank et al. | |
| 2013/0153300 | A1 | 6/2013 | Radford et al. | |
| 2013/0206401 | A1 | 8/2013 | Bhoite et al. | |
| 2014/0332270 | A1 | 11/2014 | Odell et al. | |
| 2015/0068804 | A1 | 3/2015 | Keshavan et al. | |
| 2015/0083497 | A1 | 3/2015 | Mageren et al. | |
| 2015/0257605 | A1 | 9/2015 | Berry | |
| 2015/0361726 | A1 | 12/2015 | Ilhein et al. | |
| 2017/0163809 | A1 | 6/2017 | Wu | |

FOREIGN PATENT DOCUMENTS

| | | | |
|---|---|---|---|
| WO | 2015114408 | A1 | 8/2015 |
| WO | 2017046613 | A1 | 3/2017 |

* cited by examiner

DOWNHOLE CUTTING TOOL AND METHOD OF USE

The present invention relates to a downhole tool and method of use, and in particular to downhole tubular cutting tool. A particular aspect of the invention relates to a tool string comprising a cutting tool and at least one other downhole tool.

BACKGROUND TO THE INVENTION

During well construction, a hole is drilled to a predetermined depth and a casing is run into the well. Cement is pumped down the casing and is displaced up the annulus between the casing and the original wellbore. The purpose of the cement is to secure the casing in position and ensure that the annulus is sealed.

Over time, which may be several decades, the production of hydrocarbons reduces until the production rate of the well is no longer economically viable, at which point the well has reached the end of its productive life. The well is plugged and abandoned.

Typically to abandon the wellbore a cement plug is placed in the wellbore casing to seal the wellbore casing annulus. It is known to use downhole casing cutters lowered into the casing to cut the casing above the cement plug and to remove the severed casing section from the wellbore. This task involves multiple trips downhole.

Other downhole tools must be lowered into the casing to allow a range of downhole tasks to be performed including drills or milling tools to extend the wellbore or dress-off cement plugs and packers to seal the wellbore.

Often a number of downhole tasks must be completed which require multiple trips downhole to perform each task. This can be a time consuming and expensive process requiring the tool string to be returned to surface to change out the downhole tool for each specific task.

SUMMARY OF THE INVENTION

It is an object of an aspect of the present invention to obviate or at least mitigate the foregoing disadvantages of prior art downhole tools.

It is another object of an aspect of the present invention to provide a robust, reliable and compact downhole cutting tool suitable for use on a tool string.

It is a further object of an aspect of the present invention to provide a tool string with a downhole cutting tool and at least one other downhole tool capable of performing a range of downhole tasks with improved productivity and efficiency.

Further aims of the invention will become apparent from the following description.

According to a first aspect of the invention there is provided a downhole cutting tool comprising:

a tool body;

a first flow pathway through the tool body;

a second flow pathway through the tool body;

a cutting mechanism configured to be in fluid communication with the second fluid flow pathway and a switching mechanism operable to control the opening of the first and/or second fluid flow pathway.

By providing a tool capable of controlling the opening of the fluid flow paths in the downhole cutting tool it may allow the controlled actuation of the cutting tool and at least one other tool on the same tool string. This may facilitate multiple downhole operations to be performed on a single trip.

Preferably the switching mechanism may be operable to control the opening of the first and/or second fluid flow pathway in response to an axial force. The switching mechanism may be operable to control the opening of the first and/or second fluid flow pathway in response to an axial force acting on the switching mechanism and/or tool body.

The switching mechanism may be actuated by a set-down weight and/or a drop ball.

Preferably the switching mechanism comprises a mandrel which is configured to be axial moveable relative to the tool body. The mandrel may be axially moved from a first position to a second position in response to an axial force. The mandrel may be axially moved from a first position to a second position in response to an axial force acting on the mandrel.

The mandrel may have a first set of ports and a second set of ports in fluid communication with the mandrel bore and/or tool string bore.

The first set of ports may be in fluid communication with the first fluid flow pathway. The second set of ports may be in fluid communication with the second fluid flow pathway.

The mandrel may be configured to move the first set of ports between a first position where they are in fluid communication with the first fluid flow pathway and a second position where they are not in fluid communication with the first fluid flow pathway.

The mandrel may be configured to move the second set of ports between a first position where they are not in fluid communication with the second fluid flow pathway and a second position where they are in fluid communication with the second fluid flow pathway.

Preferably the mandrel is configured to be moved between a first position where the first set of ports are not in fluid communication with the first fluid flow pathway and the second set of ports are in fluid communication with the second fluid flow pathway in response to an axial force.

Preferably the mandrel is configured to be moved to a position where the first set of ports are in fluid communication with the first fluid flow pathway and the second set of ports are not in fluid communication with the second fluid flow pathway when the axial force is removed.

The switching mechanism may comprise a drop ball seat.

The axial force may be applied to the switching mechanism by a set down weight and/or a ball drop. This may allow the tool to perform a number of downhole tasks in a single trip without having to return to surface or perform multiple trips.

The tool may comprise a third fluid flow path configured to direct at least some fluid flow into the annular space around the tool.

By directing at least part of the fluid flow into the annular space around the tool it may allow fluid flow to cool a tool on the tool string such as drilling tools. It may allow cuttings and debris to be washed away from cutting sites.

By providing a switching mechanism the tool in response to an axial force may switch the flow regime in the tool. The tool may have an initial flow pathway where the fluid flow passes through the tool to actuate a tool on the same tool string, and the switching mechanism in response to an axial force switches the tool to a second flow pathway where flow through the second flow pathway actuates the cutting mechanism.

A further benefit of this system is that different downhole tools with specific hydraulic actuation flow rates may be controlled on the same tool string. Drill tools and milling tools that require a high flow rate may be located beneath the cutter tool on the tool string and may be independently controlled.

The first flow pathway and/or second flow pathway may be open before an axial force is applied to the switching mechanism. The first flow pathway and/or second flow pathway may be closed before an axial force is applied to the switching mechanism.

The switching mechanism may be configured to open the first pathway and close or partially close the second pathway in response to an axial force. The switching mechanism may be configured to open the second pathway and close or partially close the first pathway in response to an axial force.

The switching mechanism may be configured to selectively open one of the first or the second fluid flow pathways.

The first flow pathway may be configured to bypass the cutting mechanism.

The cutter mechanism comprises at least one extendable cutter. The cutter may comprise at least one blade or knife. Preferably the cutting mechanism comprises a plurality of cutters. The plurality of cutters may be circumferentially disposed about a section of the downhole tool.

The cutting tool may comprise a sleeve piston configured to be slidably mounted within the tool body. The sleeve position may be configured to move the cutters between a storage position where the cutters are retracted and do not engage the casing and an operational position where the cutters are extended and engage the casing.

The piston may be configured to move between a first position and a second position. In the first position the position may retain the at least one cutter in retracted position. The piston may be configured to move the cutters to an extended operation position when the piston is in the second position. The piston may comprise a shoulder. The shoulder may be configured to engage the at least one cutter.

The first flow pathway may be configured to bypass or partially bypass the piston.

The cutting mechanism may be hydraulically actuated. Preferably the cutting mechanism is actuated by directing fluid into the second fluid flow path. The cutting mechanism may be configured to move in response to fluid pressure acting on the sleeve piston.

The cutting mechanism may be configured to be actuated in response to fluid flow in the second fluid flow pathway.

The cutting mechanism may comprise a flow restriction assembly. The flow restriction assembly may comprise a nozzle. The nozzle may be configured to introduce a pressure difference in the fluid upstream of the nozzle and the fluid downstream of the nozzle. The nozzle may be dimensioned to provide resistance to fluid flowing into nozzle. The restriction assembly and/or the piston sleeve may be configured to move axially when fluid acts on the nozzle. The restriction assembly and/or the piston sleeve may be configured to move axially when fluid above a predetermined threshold flows through the second pathway and acts on the nozzle.

The piston may comprise a nozzle. The nozzle on the piston may be larger than the nozzle on the restriction assembly.

Preferably axial movement of the restriction assembly and/or the piston sleeve when fluid flows through the second pathway deploys the cutters.

The downhole cutting tool may comprise a tool string coupled to a downhole tool. The downhole cutting tool may comprise a tool string coupled to a hydraulically actuated downhole tool. The downhole cutting tool may comprise a tool string coupled to a series of hydraulically actuated downhole tools.

The hydraulically actuated downhole tool may be selected from a drill, mill, packer, bridge plug, hydraulic disconnects, whipstock, hydraulic setting tools or perforating gun.

According to a second aspect of the invention there is provided a downhole cutting tool comprising:

a tool body;

a first flow pathway through the tool body;

a switching mechanism configured to open a second flow pathway through the tool body and;

a cutting mechanism configured to be in fluid communication with the second fluid flow pathway.

Preferably the switching mechanism is configured to open a second flow pathway through the tool body in response to an axial force.

The cutting mechanism may be configured to be actuated in response to fluid flow in the second fluid flow pathway.

The cutting mechanism may be configured to be actuated in response to fluid flow above a threshold flow rate in the second fluid flow pathway.

Embodiments of the second aspect of the invention may include one or more features of the first aspect of the invention or its embodiments, or vice versa.

According to a third aspect of the invention there is provided a downhole cutting tool comprising:

a tool body;

a first flow pathway through the tool body;

a second flow pathway through the tool body;

a cutting mechanism configured to be actuated in response to fluid flow in the second fluid flow pathway and a switching mechanism configured to selectively open one of the first or the second fluid flow pathways in response to an axial force Embodiments of the third aspect of the invention may include one or more features of the first or second aspect of the invention or their embodiments, or vice versa.

According to a fourth aspect of the invention there is provided a tool string comprising a downhole cutting tool comprising:

a tool body a first flow pathway through the tool body;

a second flow pathway through the tool body;

a cutting mechanism configured to be in fluid communication with the second fluid flow pathway;

a switching mechanism operable to control the opening of the first and/or second fluid flow pathway.

and a hydraulically operated tool wherein the hydraulically operated tool is configured to be actuated by fluid flowing through the downhole cutting tool.

The hydraulically operated tool may be configured to be actuated by fluid flowing through the first and/or second flow pathway through the cutting tool body.

The switching mechanism may be actuated by a set-down weight and/or a drop ball.

Preferably the switching mechanism may be operable to control the opening of the first and/or second fluid flow pathway in response to an axial force.

The switching mechanism may be configured to selectively open one of the first or the second fluid flow pathways in response to an axial force.

The hydraulically actuated downhole tool may be selected from a drill, mill, packer, bridge plug, hydraulic disconnects, whipstock, hydraulic setting tools or perforating gun.

Embodiments of the fourth aspect of the invention may include one or more features of the first, second or third aspects of the invention or their embodiments, or vice versa.

According to a fifth aspect of the invention there is provided a tool string comprising a downhole cutting tool comprising:

a tool body;

a first flow pathway through the tool body;

a switching mechanism configured to open a second flow pathway through the tool body and;

a cutting mechanism configured to be in fluid communication with the second fluid flow pathway.

and a hydraulically operated tool;

wherein the hydraulically operated tool is configured to be actuated by fluid flowing through the downhole cutting tool.

Preferably the switching mechanism is configured to open a second flow pathway through the tool body in response to an axial force.

The cutting mechanism may be configured to be actuated in response to fluid flow in the second fluid flow pathway.

The cutting mechanism may be configured to be actuated in response to fluid flow above a threshold flow rate in the second fluid flow pathway.

Embodiments of the fifth aspect of the invention may include one or more features of the first to fourth aspects of the invention or their embodiments, or vice versa.

According to a sixth aspect of the invention there is provided a tool string comprising a downhole cutting tool comprising:

a tool body a first flow pathway through the tool body;

a second flow pathway through the tool body;

a cutting mechanism configured to be in fluid communication with the second fluid flow pathway;

a mechanism configured to selectively open one of the first or the second fluid flow pathways in response to an axial force; and a drill tool;

wherein the drill tool is configured to be actuated by fluid flowing through the cutting tool body.

The drill tool may be configured to be actuated by fluid flowing through the first and/or second flow pathway through the tool body of the cutting tool.

Embodiments of the sixth aspect of the invention may include one or more features of the first to fifth aspects of the invention or their embodiments, or vice versa.

According to a seventh aspect of the invention there is provided a method of operating a downhole cutting tool comprising:

providing a downhole cutting tool comprising a tool body;

a first flow pathway through the tool body;

a second flow pathway through the tool body;

a cutting mechanism configured to be in fluid communication with the second fluid flow pathway and a switching mechanism operable to control the opening of the first and/or second fluid flow pathway;

opening the second fluid flow pathway;

pumping fluid through the second flow path to actuate the cutting mechanism.

The method may comprise opening the second fluid flow pathway by actuating the switching mechanism. The method may comprise actuating the switching mechanism by providing an axial force. The axial force may be a set-down weight or a drop ball.

The method may comprise actuating the cutting mechanism by pumping a fluid flow into the second fluid flow pathway. The method may comprise rotating the tool whilst the cutters are deployed to cut the casing. The method may comprise cutting the casing by rotating a tool string connected to the downhole tool.

The method may comprise monitoring the fluid pressure circulating through the downhole tool. The method may comprise deactivating the cutting mechanism based on the monitored fluid pressure level circulating through the downhole tool.

The method may comprise monitoring the force required to rotate the cutting mechanism.

The method may comprise actuating the cutting mechanism by rotating the cutting mechanism to cut the casing. The cutting mechanism may be rotated by rotating a tool string connected to the downhole tool.

The method may comprise monitoring the force required to rotate the cutting mechanism.

Embodiments of the seventh aspect of the invention may include one or more features of any of the first to sixth aspects of the invention or their embodiments, or vice versa.

According to an eighth aspect of the invention there is provided a method of operating a tool string in a wellbore tubular comprising:

providing a tool string comprising a downhole cutting tool comprising:

a tool body;

a first flow pathway through the cutting tool body;

a second flow pathway through the cutting tool body;

a cutting mechanism configured to be in fluid communication with the second fluid flow pathway;

a switching mechanism operable to control the opening of the first and/or second fluid flow pathway; and and a drill tool;

actuating the drill;

opening the second fluid flow pathway and pumping fluid into the second fluid flow pathway to actuate the cutting mechanism.

The method may comprise opening the second fluid flow pathway subsequent to actuating the drill. The method may comprise closing the first fluid flow pathway. The method may comprise actuating the drill by passing fluid through the first and/or second flow pathway through the cutting tool body.

The method may comprise actuating the switching mechanism by providing an axial force. The axial force may be a set-down weight or a drop ball.

Embodiments of the eighth aspect of the invention may include one or more features of any of the first to seventh aspects of the invention or their embodiments, or vice versa.

According to a ninth aspect of the invention there is provided a method of actuating a downhole tool on a tool string comprising:

providing a tool string comprising:

a downhole cutting tool comprising:

a tool body;

a first flow pathway through the tool body;

a second flow pathway through the tool body;

a cutting mechanism configured to be in fluid communication with the second fluid flow pathway and a switching mechanism operable to control the opening of the first and/or second fluid flow pathway; and a downhole tool;

lowering the tool string into the wellbore;

pumping fluid through the first flow pathway to actuate the downhole tool.

The method may comprise actuating the switching mechanism to open the first flow pathway. The method may comprise actuating the switching mechanism to close the second flow path.

The tool may be selected from hydraulically actuated downhole tools including a drill, mill, packer, bridge plug, hydraulic disconnects, whipstock, hydraulic setting tools or perforating gun.

Embodiments of the ninth aspect of the invention may include one or more features of any of the first to eighth aspects of the invention or their embodiments, or vice versa.

According to a tenth aspect of the invention there is provided a method of dressing off a cement plug and cutting a wellbore tubular comprising:

providing a tool string comprising a downhole cutting tool comprising:

a tool body;

a first flow pathway through the tool body;

a second flow pathway through the tool body;

a cutting mechanism configured to be in fluid communication with the second fluid flow pathway and a switching mechanism operable to control the opening of the first and/or second fluid flow pathway; and a drill tool;

lowering the tool string such that the drill is located on a cement plug;

actuating the drill;

repositioning the tool string in the tubular at a desired depth; and actuating the cutting mechanism to cut the tubular.

The switching mechanism may be configured to selectively open one of the first or the second fluid flow pathways in response to an axial force.

The method may comprise actuating the drill by passing fluid through the first and/or second flow pathway through the cutting tool body.

The method may comprise actuating the cutting mechanism opening the second fluid flow pathway and pumping fluid into the second fluid flow pathway. The method may comprise closing the first fluid flow pathway.

Embodiments of the tenth aspect of the invention may include one or more features of any of the first to ninth aspects of the invention or their embodiments, or vice versa.

According to an eleventh aspect of the invention there is provided of actuating a downhole cutting tool on a tool string, the method comprising:

providing a downhole cutting tool on a tool string, the cutting tool comprising a tool body;

a first flow pathway through the tool body;

a second flow pathway through the tool body;

a cutting mechanism configured to be actuated in response to fluid flow in the second fluid flow pathway and a switching mechanism configured to control the opening of the first and/or second fluid flow pathway in response to an axial force;

setting down a weight on the tool string;

pumping fluid into the second fluid flow pathway to actuate the cutting mechanism.

Preferably the switching mechanism comprises a mandrel. Preferably the mandrel is axially moveable in the tool body.

The method may comprise transmitting the set down weight to the mandrel to move the mandrel axially in the tool body.

Embodiments of the eleventh aspect of the invention may include one or more features of any of the first to tenth aspects of the invention or their embodiments, or vice versa.

According to a twelfth aspect of the invention there is provided a method of actuating a downhole cutting tool on a tool string, the method comprising:

providing a downhole cutting tool on a tool string, the cutting tool comprising a tool body;

a first flow pathway through the tool body;

a second flow pathway through the tool body;

a cutting mechanism configured to be actuated in response to fluid flow in the second fluid flow pathway and a switching mechanism comprising a ball seat configured to control the opening of the first and/or second fluid flow pathway.

The method may comprise releasing an actuating ball in the tool string to engage the ball seat.

Embodiments of the twelfth aspect of the invention may include one or more features of any of the first to eleventh aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1A:
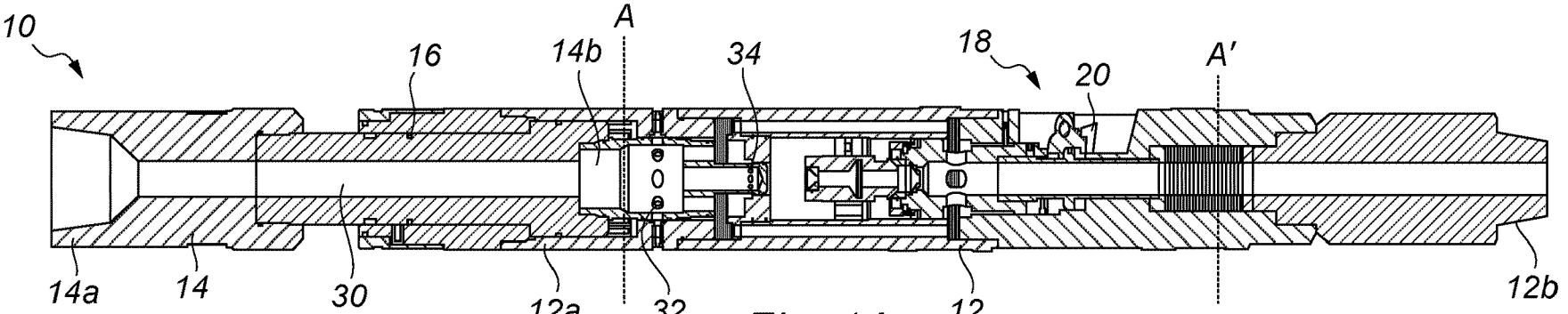
FIG. 1A is a longitudinal sectional view through the downhole tool in first operational mode according to a first embodiment of the invention
Figure 2A:
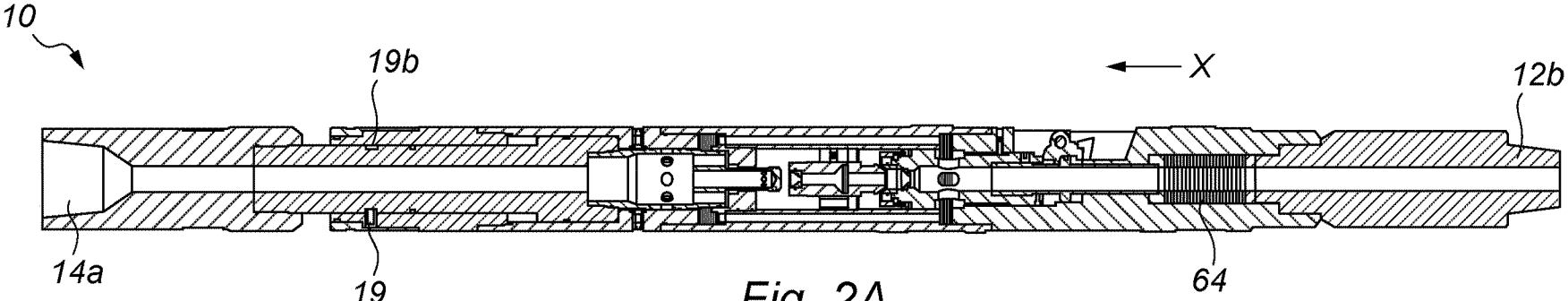
FIG. 2A is a longitudinal sectional view through the downhole tool in a second operational mode according to an embodiment of the invention.
Figure 3A:
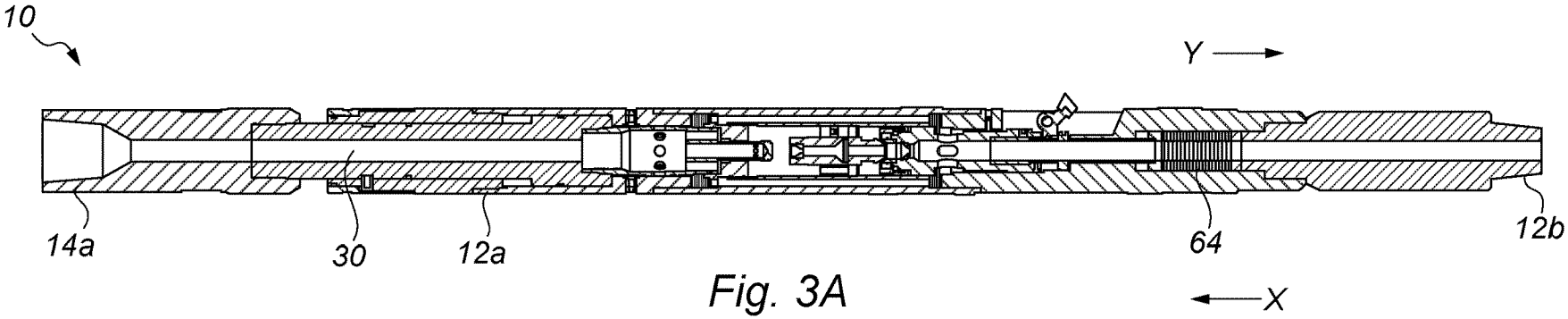
FIG. 3A is a longitudinal sectional view through the downhole tool in a cutting mode according to an embodiment of the invention.

FIGS. 1A, 2A and 3A are longitudinal sectional views of a downhole tool in accordance with a first embodiment of the invention in different phases of operation.

FIG. 1A is a longitudinal section through the downhole tool 10. The downhole tool 10 has an elongate body 12 and a mandrel 14.

A first end 14*a* of the mandrel 14 is configured to be coupled to an upper tool string such as a drill string (not shown). The second end 14*b* of the mandrel is axially movably mounted in the body 12.

A first end 12*a* of the body 12 surrounds a portion of mandrel 14. The second end 12*b* of the body is configured to be coupled to a lower tool string such as a drill string (not shown). The lower tool string may be connected to downhole tool located further downhole. The second end 12*b* of the body is designed for insertion into a downhole tubular first.

The mandrel 14 is configured to be axially moveable in the body and is held in a first position by sheer screws 16. The tool body 12 comprises a cutting mechanism 18 configured to deploy knifes 20 to cut the casing.

Figure 1B:
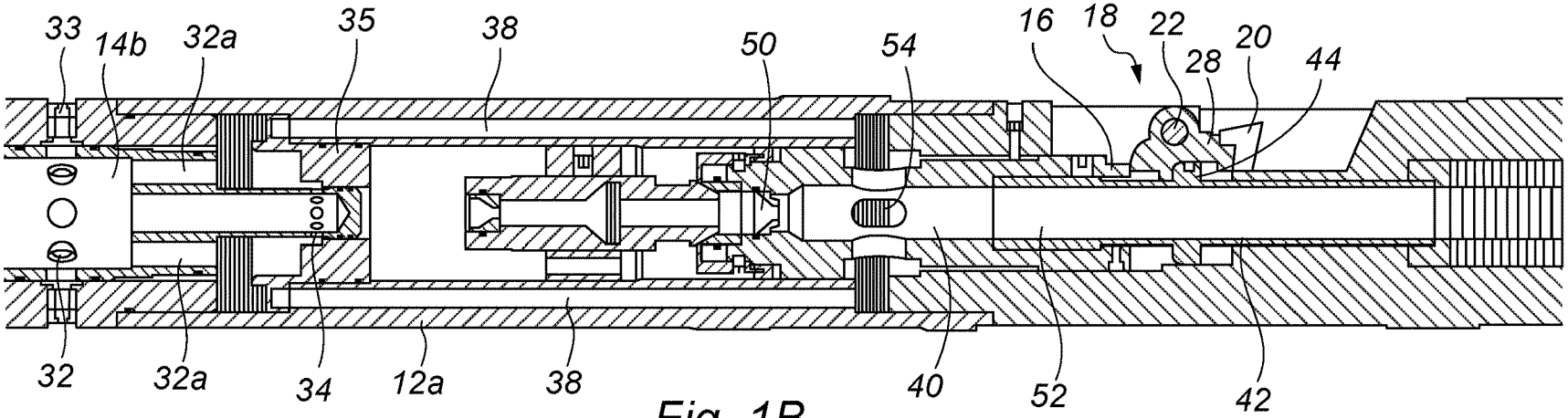
FIG. 1B is an enlarged view of a section of the downhole tool of FIG. 1A.
Figure 1C:
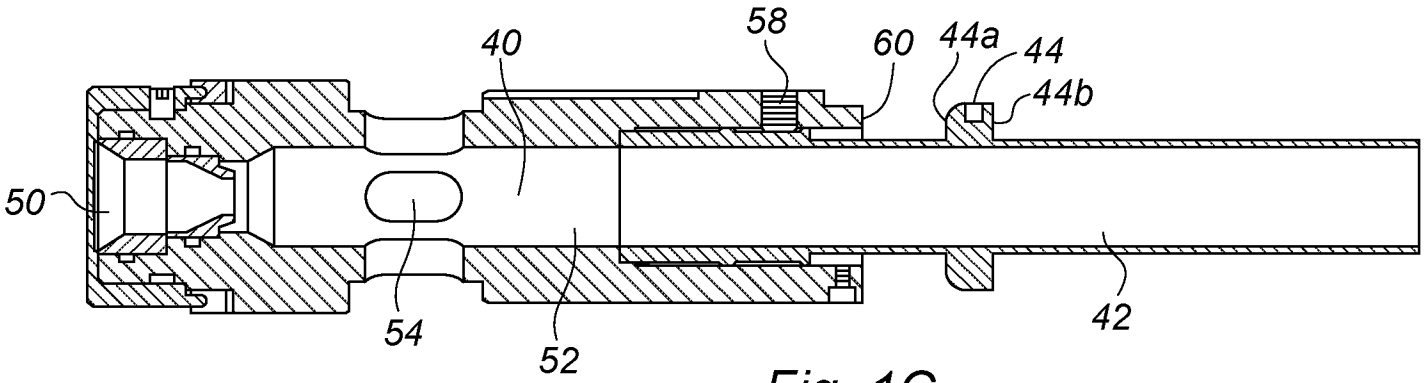
FIG. 1C is an enlarged view of the piston of the embodiment of FIG. 1A.
Figure 1D:
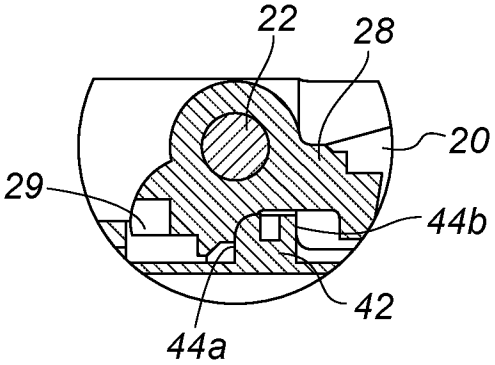
FIG. 1D is an enlarged view of the pivot arm of the embodiment of FIG. 1A

FIG. 1B shows an enlarged view of area A-A" of FIG. 1A. As shown in FIG. 1A the cutting mechanism 18 comprises a plurality of knives 20 disposed circumferentially around the tool body 12. (One knife 20 is shown in FIGS. 1A and 1B). The knives 20 are rotatably mounted on pivot 22, best shown in FIG. 1D, and are configured to move between a storage position where the knives are retracted shown in FIG. 1A and an operational position where the knives are deployed shown in FIGS. 3A and 3B.

The mandrel 14 has a central bore 30 which is closed at the second end 14*b*. At the second end 14*b* of the mandrel are located a first set of ports 32 and second set of ports 34. The first and second sets of ports are axially separated from one another. Ports 32 are in fluid communication with channels 32*a* in the mandrel 14.

FIGS. 1B and 10 shows a piston 40 which is axially movably mounted in the body 12. The piston 40 is configured to move axially between a first position shown in FIG. 1A and second position shown in FIG. 3A. Although it is shown to move between a first and second position, intermediate positions may be selected. The piston 40 comprises a piston sleeve 42. The piston sleeve 42 has a first shoulder 44. Side 44*a* of shoulder 44 is configured to engage a pivot arm 28 connected to the cutting knives 20, best shown in FIG. 1D. In the first mandrel position the position of the first shoulder 44 hinders the rotation of the pivot arm 28 and maintains the knives in a retracted position.

The piston 40 has an inlet nozzle 50 to a central bore 52 which extends through the piston 40. Ports 54 extend into the central bore 52 of the piston.

The shoulder 44 is configured to minimize the maximum cutting OD (sweep) of the knives when cutting. Side 44*b* of shoulder 44 is configured to stop the piston 40 at a set cutting OD (Sweep). The side 44*b* of shoulder 44 may be configured to stop the piston 40 by engaging with a shoulder 47 on the tool body at a set cutting outer diameter sweep. The maximum cutting OD may be adjusted. The maximum cutting OD may be adjusted by changing the position of the sleeve 42 on the piston 40. The sleeve is threaded attached to the piston 40 and the maximum cutting OD can be adjusted by rotating the sleeve. The sleeve position is secured in position by set screws 58. Alternatively, or additionally a screw may be provided that limits the amount the sleeve can be adjusted (not shown).

The piston 40 comprises a shoulder 60. Shoulder 60 is configured to engage the pivot arm 28 connected to the cutting knives 20 and to pivotally move the knives 20 between a knife storage position shown in FIG. 1A and an operational position shown in FIG. 3A when a fluid pressure is applied to piston 40.

The mandrel 14 is held in a first position relative to the body 12 by shear screws 16. The mandrel is configured to move from the first position shown in FIG. 1A to a second position shown in FIG. 2A.

In the first mandrel position a first fluid flow pathway through the tool is open. The first pathway consists of channels 32*a* on the mandrel 14 in fluid communication with a bypass channel 38. The bypass channel 38 is in fluid communication with ports 54 on the piston 40.

In a first mandrel position the ports 32 align with ports 33 and on the tool body. Fluid that flows through ports 32 and 33 flows into the annular space which may aid in the removal of cutting and/or debris from cutting and/or drill sites.

During normal circulation mode, fluid flows through a first flow pathway in the tool and may actuate and/or control another tool located further downhole on the tool string.

Fluid flowing through the upper tool string first flows through the first flow pathway then through bore 30 of the mandrel. Fluid flows through bore 30 through channels 32*a* into the bypass channel 38. The flow continues through ports 54 on the piston 40 into the bore 52. The fluid flows in the inner bore of the tool string and may be used to actuate at least one downstream hydraulic tool such as a drill, packer or bridge plug (not shown). Some fluid flows through ports 32 and 33 into the annular space.

In the first mandrel position the ports 34 are blocked by port valve 35 which prevents flow from acting on the piston sleeve to actuate the cutter mechanism 18.

In the first mandrel position, the tool 10 can be rotated on the work string and fluid may be pumped through this first pathway without actuating the cutting mechanism and deploying the knives. This may facilitate the actuation of a downstream tool to enable multiple tasks to be performed in once the tool is deployed downhole without requiring the tool to return to surface.

Flow through the tool may control the actuation of a downstream tool such as a drill or mill and may enable cement dressing off of a cement plug prior to the casing being cut by the cutting mechanism.

Figure 4:
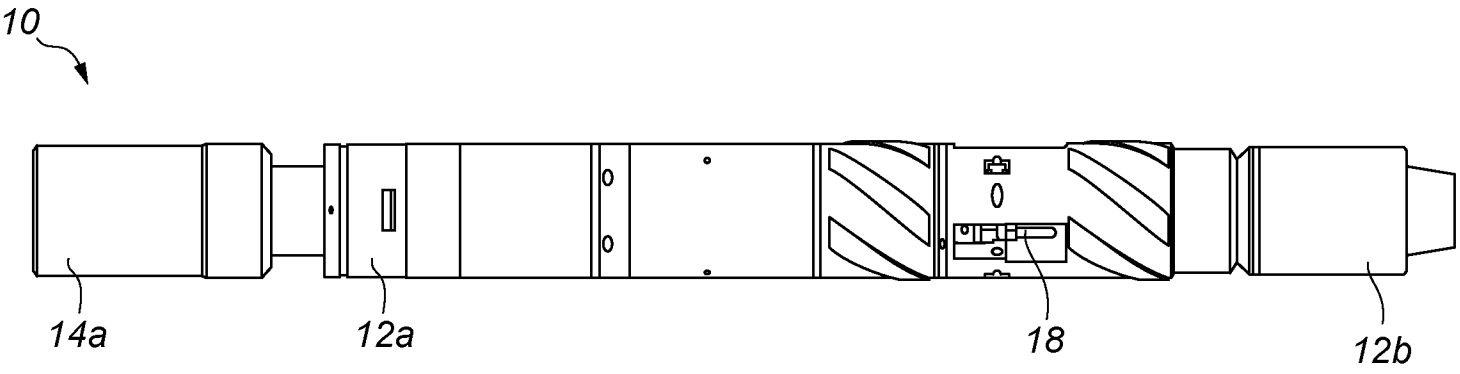
FIG. 4 is a longitudinal view of the downhole tool of FIG. 1A according to an embodiment of the invention.
Figure 5A:
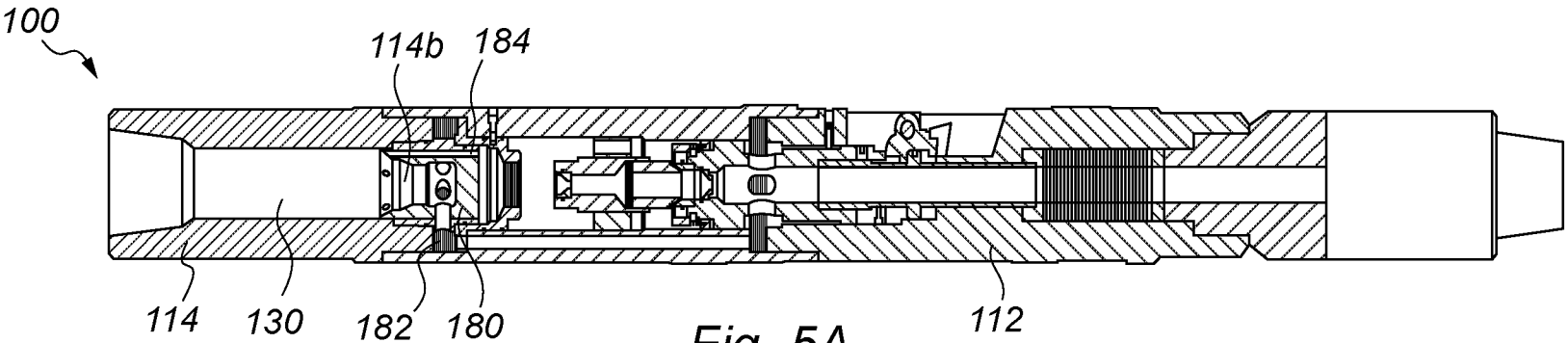
FIG. 5A is a sectional view of a downhole tool in first operational mode according to an embodiment of the invention.
Figure 5B:
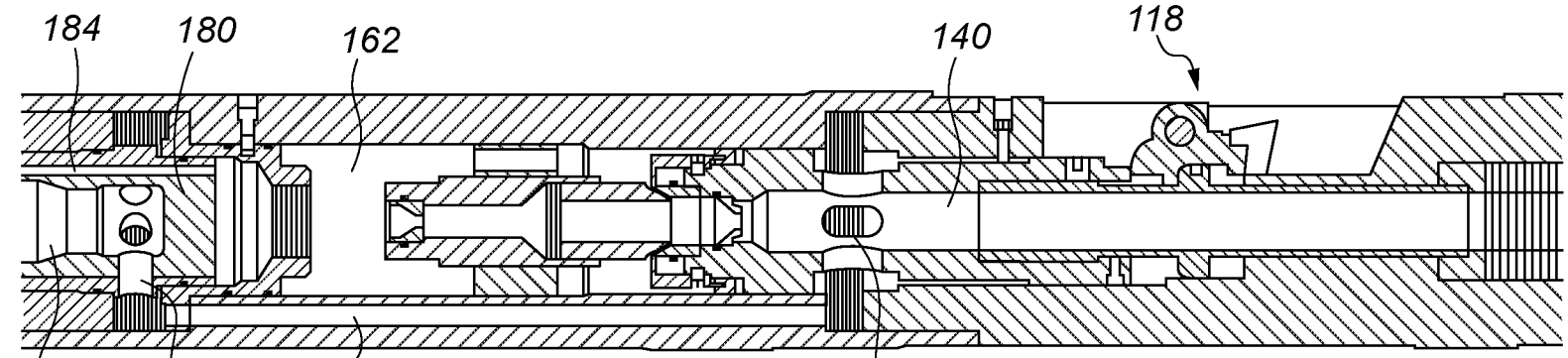
FIG. 5B is an enlarged view of a section of the downhole tool of FIG. 5A.

By proving a first pathway which bypasses the actuating of the cutting mechanism in the first mandrel position the tool may allow a high fluid flow rate to be pumped through the tool. The tool may also allow the transfer torque to a downstream tool such as a drill bit or mill without actuating the cutting mechanism. FIG. 4 shows a longitudinal view of the tool in circulation mode.

In order to move the mandrel from a first position to a second position an axial load is applied to the mandrel 14. The axial load may be provided by a set down weight or hydraulic pressure. In this example the axial load is provided by a set-down weight which moves the mandrel from the first axial position shown in FIG. 1A to a second axial position shown in FIG. 2A.

Figure 2B:
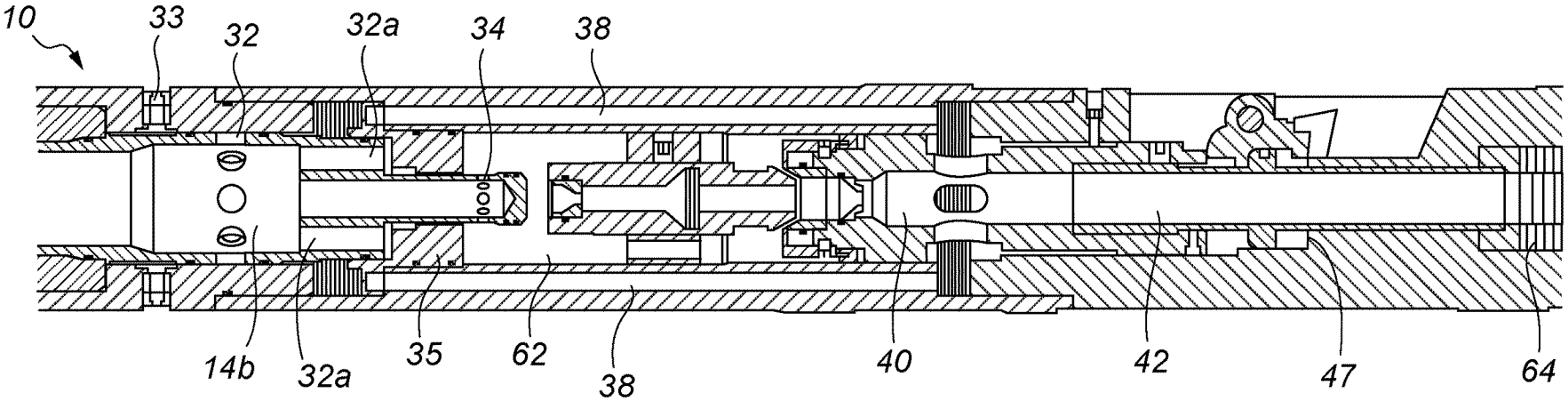
FIG. 2B is an enlarged view of a section of the downhole tool of FIG. 2A.

The mandrel 14 is configured to be moved within the body 12 to a second position as shown in FIGS. 2A and 2B. The mandrel is held in the second position by spring activated keys 19 located in an internal surface of body 12 engaging with grooves 19*a* located on the outer surface of the mandrel.

FIGS. 2A and 2B show the mandrel in the second position where the mandrel 14 closes the first pathway and opens a second pathway. The mandrel 14 is moved axially such that ports 32 are not aligned with ports 33 on the body preventing fluid flow from the bore 30 into the annular space. The channels 32*a* are blocked by port valve 35 and are no longer in fluid communication with the bypass channel 38. The ports 34 on the second end 14*b* of the mandrel are moved through port valve 35 into chamber 62 in the body 12.

The piston 40 is biased in a direction X by spring 64 as shown in FIG. 2A. In this example the spring 64 is a compression spring. However, it will be appreciated that any spring, compressible member or resilient member may be used to bias the sleeve in a first position.

The spring force acting on the piston provided by spring 64 in direction X maintains shoulder 44 in contact with pivot arm 28 and prevents pivot arm 28 from rotating and deploying the knives 20.

Figure 3B:
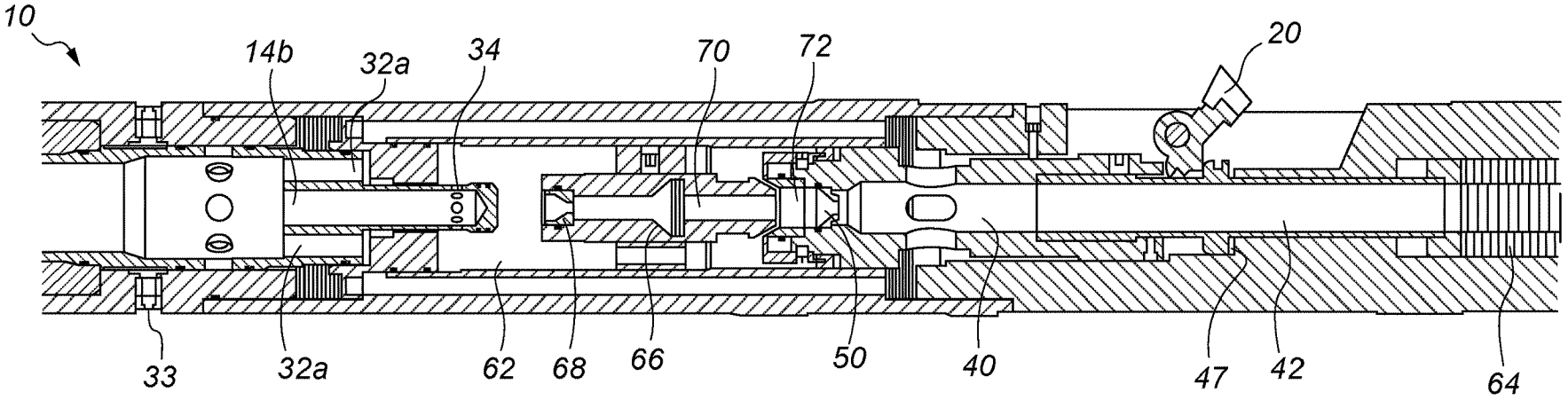
FIG. 3B is an enlarged view of a section of the downhole tool of FIG. 3A.

FIGS. 3A and 3B show the actuation of the cutting mechanism when the mandrel in is the second position. Fluid is pumped into the tool string and flows through the second pathway to actuate the cutting mechanism.

Fluid passes through the second pathway. Fluid flows through bore 30 of the mandrel into the chamber 62 via ports 34 on the mandrel 14. The chamber 62 is in fluid communication with an axially moveable restrictor assembly 66. The flow resistor assembly 66 has an inlet nozzle 68, a bore 70 and an outlet 72. The inlet nozzle 68 is configured to introduce a pressure difference in the fluid upstream of the inlet nozzle 68 and the fluid downstream of the inlet nozzle 68.

The fluid flows through the nozzle 68 of the flow restrictor assembly 66. The nozzle 68 is dimensioned to provide a resistance to flow. When the fluid pressure applied to the nozzle 68 it moves the flow resistor assembly 66 in direction Y as shown in FIG. 3A. The outlet 72 of flow restrictor assembly 66 is aligned and/or seated on inlet nozzle 50. When the fluid pressure applied to the nozzle 68 is sufficient to overcome the spring force of spring 64 the flow restrictor assembly 66 and piston 40 are moved towards second end 12*b* of the downhole tool, shown as direction Y in FIG. 3A.

The flow resistor assembly 66 may be adjusted to stop at selected position after travelling a predetermined distance in direction Y. When the flow resistor assembly 66 stops at this selected position the outlet 72 of flow restrictor assembly 66 will not be aligned and/or seated in inlet nozzle 50. Flow will bypass the smaller nozzle 68, and will flow through the larger sleeve inlet nozzle 50. This may provide a pressure change when the knives are at a certain cutting OD (sweep) and provide an indication that the knives are deployed and/or the cut has been made.

Movement of the piston 40 and sleeve 42 in direction Y axially moves shoulder 60 to engage and move pivot arm 28 connected to the cutting knives 20. The knives 20 are moved to an operational position to allow the cutting of a casing shown in FIG. 3A.

The pivot arm 28 has a slot 29 (best shown in FIG. 1D) which prevents the pivot arm impacting the sleeve when the knife is rotated to an extended position.

To retract the knives 20, the fluid flow through the second pathway is reduced. The fluid pressure applied to nozzle 68 and/or nozzle 50 is no longer sufficient to overcome the spring force of spring 64 and the flow restrictor assembly 66, piston 40 and sleeve 42 are moved towards first end 12*a* of the downhole tool, shown as direction X in FIG. 3A.

The movement of the piston 40 in direction X moves the shoulder 60 to disengage with the pivot arm 28. Shoulder 44 engages with the pivot arm 28 which rotates pivot arm 28 and retract the knives 20.

The fluid pumped through the second pathway may be adjusted to control the degree of deployment of the knives 20.

The tool and/or tool string may be rotated with the knives deployed to cut the tubular. The tool can be rotated when the knifes are in an operational or retracted position. The tool has a spline that transfer the torque in both positions.

The tool described above may be provided with a plurality of seals. Seals may be provided along the first and/or second pathway to prevent fluid egress. Seals may be provided between the mandrel and the tool body.

The above example described the switching between a first mandrel position and a second mandrel position by applying an axial force in the form of a set-down weight. However, an alternative method applying an axial force is a ball-drop.

FIGS. 5A, 5B, 6A and 6B show an alternative design for downhole tool 110. The tool comprises a ball seat 180 at end 114*b* of mandrel 114. The ball seat 180 has first series of ports 182 and a second series of ports 184 (shown best in FIG. 5B). The first series of ports 182 are aligned with the first pathway. The first fluid pathway is similar to the first fluid pathway described in relation to FIGS. 1A and 1B and will be understood from the description of FIGS. 1A and 1B above.

During normal circulation mode, the first fluid flow pathway through the tool is open. The first pathway consists of first series of ports 182 on the ball seat 180 which are in fluid communication with a bypass channel 138. The bypass channel 138 is in fluid communication with ports 154 on the piston 140.

Fluid flows through the first flow pathway and may actuate and/or control a hydraulically operated tool located further downhole on the tool string.

Some flow may pass through the second series of ports 184 in the ball seat and into the second flow path. The second flow path is similar to the second fluid pathway described in relation to FIGS. 2A and 2B and will be understood from the description of FIGS. 2A and 2B above. The second fluid pathway consists of series of ports 184 on the ball seat 180 which are in fluid communication with chamber 162. The chamber 162 is in fluid communication with the cutting mechanism 118. However, during normal circulation mode the flow through the second flow path is not sufficient to actuate the cutting mechanism 118.

Figure 6A:
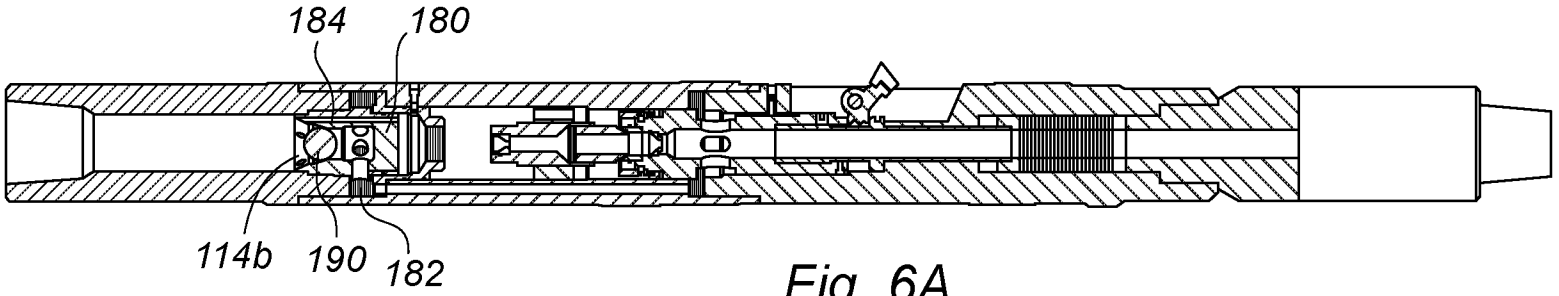
FIG. 6A is a longitudinal sectional view through of the downhole tool of 5A in a cutting mode according to an embodiment of the invention.
Figure 6B:
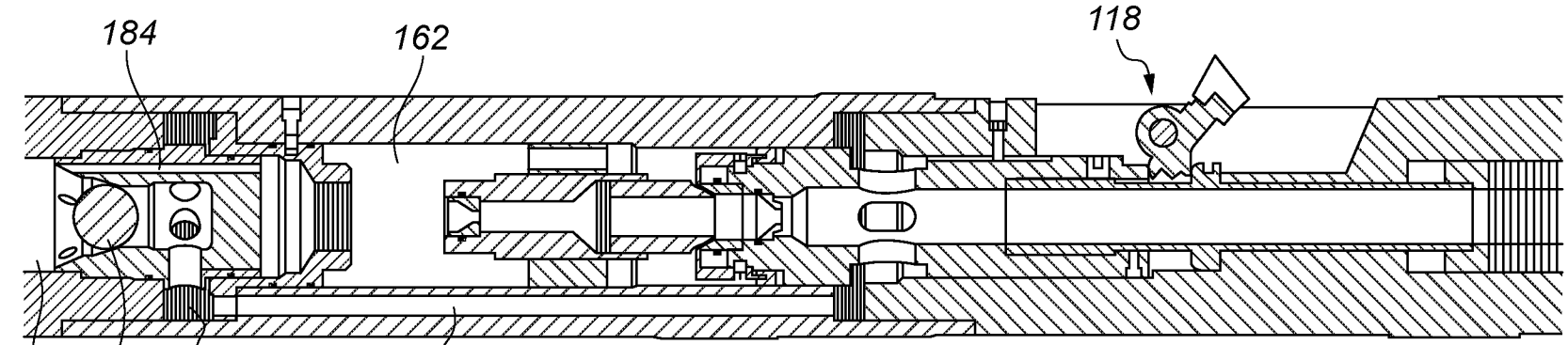
FIG. 6B is an enlarged view of a section of the downhole tool of FIG. 6A.

FIGS. 6A and 6B show actuation of the cutting mechanism. To actuate the cutting mechanism 118 a ball 190 is dropped in the bore of the tool string and is carried by fluid flow through bore 130 until it is retained by the ball seat 180. Once the ball 190 has engaged the ball seat 180 the ball 190 blocks ports 182 preventing fluid flow in the first pathway. Fluid is directed though ports 184 into the chamber 162 and through the second pathway. The actuation of the cutting mechanism is as described in relation to FIGS. 3A and 3B and will be understood from the description of FIGS. 3A and 3B.

In this example the mandrel is not axially moveable between a first and second position. In this case the first series of ports 182 are always aligned with the first pathway and the second series of ports 184 are always aligned with the second pathway.

Alternatively, and/or additionally, the mandrel and/or ball seat may be axially movable in the tool body. The mandrel and/or ball seat may be axially moveable when sufficient fluid pressure is applied to the ball and ball seat providing an axial force on the mandrel to move it to a second position.

The mandrel and/or ball seat when moved to the second position the second series of ports are aligned with the second pathway.

During normal circulation mode, fluid flows through the bore of the mandrel. The flow passes through the first flow pathway via the series of ports and may actuate and/or control a hydraulically operated tool located further downhole on the tool string.

To actuate the cutting mechanism a ball is dropped in the bore of the tool string and is carried by fluid flow where its retained by the ball seat. Once the ball has engaged the ball seat it blocks the first series of ports preventing fluid flow in the first flow pathway. The fluid pressure may act on the ball seat and when sufficient fluid pressure acts on the ball seat the mandrel and/or ball seat be axially movable to a second position in the tool body. The mandrel and/or ball seat in the second position uncovers a second series or ports which are in fluid communication with the second fluid path way. Subsequent fluid flow through the second fluid flow pathway actuates the cutting mechanism disposed in the second fluid flow pathway.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as", "lower", "upper, "up" "down" and the like are used herein to indicate directions and locations as they apply to the appended drawings and will not be construed as limiting the invention and features thereof to particular arrangements or orientations. Likewise, the term "inlet" shall be construed as being an opening which, dependent on the direction of the movement of a fluid may also serve as an "outlet", and vice versa.

The invention provides a downhole cutting tool. The tool comprises a tool body, a first flow pathway and a second flow pathway through the tool body. The tool also comprises a cutting mechanism configured to be in fluid communication with the second fluid flow pathway and a switching mechanism configured operable to control the opening of the first and/or second fluid flow pathway.

The present invention obviates or at least mitigates disadvantages of prior art downhole tools and provides a robust, reliable and compact downhole cutting tool suitable for actuating multiple downhole tool and cutting a casing in a single trip.

The invention enables multiple downhole operations to be performed on the same downhole trip, which normally would require at least two separate trips. The invention allows sufficient fluid flow to be pumped through the tool to actuate tools on the tool strings further downhole without uncontrolled actuation of the cutting tool.

The invention allows the selective actuation of different tools on the same tools string. This may facilitate the controlled actuation of downhole tools such as drills and mills which require high flow rates on the same tool string as a casing cutter tool which requires a lower fluid flow rate.

This may facilitate the actuation of a drill to dress-off a cement plug and the subsequent activation of the cutting tool to cut the casing in a single downhole trip. The invention avoids the simultaneous and/or accidental actuation of the downhole tools on the tool string. The downhole cutting tool has improved productivity and efficiency, and is capable of reliably performing multiple downhole operations once deployed downhole.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

The invention claimed is:

1. A downhole cutting tool comprising:

a mandrel, the mandrel having a central mandrel bore with a first end configured to be coupled to an upper tool string, and a first set of ports at a second end;

a tool body, the tool body comprising a cutting mechanism having a plurality of knives to cut casing, and having a first end surrounding a portion of the mandrel and a second end configured to be coupled to a lower tool string;

a piston axially moveable in a chamber of the tool body and comprising a piston sleeve with a shoulder configured to engage a pivot arm of the cutting mechanism, a piston inlet nozzle to a central piston bore and ports extending into the central piston bore;

a first flow pathway through the tool body;

a second flow pathway through the tool body;

the downhole cutting tool being switchable between a first position and a second position, wherein:

in the first position:

the first flow pathway is open, and fluid flow from the upper tool string enters the central mandrel bore, passes through the first set of ports into a bypass channel to enter the ports extending into the central piston bore and to an inner bore of the lower tool string, and the knives are retracted and held in a storage position; and in the second position:

the second flow pathway is open, the first flow pathway is closed as the bypass channel is closed, and fluid flow from the upper tool string enters the central mandrel bore, passes into the chamber to enter the inlet nozzle to the central piston bore and move the piston sleeve to engage the shoulder with the pivot arm to rotate the knives to an extended operational position to cut casing.

2. The downhole cutting tool according to claim 1 wherein the downhole cutting tool includes shear screws to hold the mandrel relative to the tool body in the first position and weight is set down to move the mandrel relative to the tool body to the second position.

3. The downhole cutting tool according to claim 1 wherein the downhole cutting tool includes a drop ball seat at the second end of the mandrel and a drop ball is used to move the mandrel relative to the tool body to the second position.

4. The downhole cutting tool claim 1 wherein the downhole cutting tool further comprises a third flow pathway configured to direct at least some fluid flow into an annular space around the tool.

5. The downhole cutting tool according to claim 4 wherein the third flow pathway is via a second set of ports, at the second end of the mandrel axially spaced from the first set of ports, and further ports on the tool body.

6. The downhole cutting tool according to claim 5 wherein the downhole cutting tool further comprises a port valve, the port valve blocking the second set of ports when the downhole cutting tool is in the second position.

7. The downhole cutting tool according to claim 1 wherein the downhole cutting tool further comprises spring activated keys located on an internal surface of the tool body which engage with grooves located on an outer surface of the mandrel to hold the mandrel in the first position.

8. The downhole cutting tool according to claim 1 wherein the downhole cutting tool includes a drop ball seat at the second end of the mandrel between the first set of ports and a second set of ports with the second set of ports having channels to direct fluid passed the first set of ports to the channel at the second end of the mandrel so that a drop ball will switch the downhole cutting tool between the first and second positions.

9. The downhole cutting tool according to claim 1 wherein the downhole cutting tool further comprises biasing means to bias the piston in the first position and the biasing means is selected from a group comprising: spring, compression spring, compressible member and resilient member.

10. The downhole cutting tool according to claim 1 wherein the cutting mechanism further comprises a flow restriction assembly axially moveable in the tool body and located in the chamber between the second end of the mandrel and the piston.

11. The downhole cutting tool according to claim 10 wherein the flow restriction assembly comprises an inlet nozzle, a bore and an outlet wherein the outlet is configured to seat in the piston inlet nozzle.

12. The downhole cutting tool according to claim 11 wherein the inlet nozzle is smaller than the piston inlet nozzle.

13. The downhole cutting tool according claim 1 wherein the tool body has a spline so as to transfer torque through the downhole cutting tool in the first and second mandrel positions.

14. The downhole cutting tool according to claim 1 wherein the downhole cutting tool comprises a tool string coupled to the downhole cutting tool as the upper tool string and the lower tool string and wherein a hydraulically actuated downhole tool is coupled to the lower tool string.

15. The downhole cutting tool according to claim 14 wherein the hydraulically actuated downhole tool is selected from a group comprising: drill, mill, packer, bridge plug, hydraulic disconnects, whipstock, hydraulic setting tools and perforating gun.

16. A method of operating a downhole cutting tool and a hydraulically actuated downhole tool on a single downhole trip comprising:

providing a downhole cutting tool according to claim 1 wherein the downhole cutting tool comprises a tool string coupled to the downhole cutting tool as the upper tool string and the lower tool string and wherein a hydraulically actuated downhole tool is coupled to the lower tool string;

running the tool string into casing with the downhole cutting tool in the first position;

pumping fluid through the downhole cutting tool via the first flow pathway to actuate the hydraulically actuated downhole tool;

switching the downhole cutting tool to the second position;

pumping fluid through the downhole cutting tool via the second flow pathway to extend the knives and thereby cut the casing.

17. The method of operating a downhole cutting tool and a hydraulically actuated downhole tool on a single downhole trip according to claim 16 wherein the method comprises setting weight down on the downhole cutting tool to switch it to the second position.

18. The method of operating a downhole cutting tool and a hydraulically actuated downhole tool on a single downhole trip according to claim 16 wherein the method comprises dropping a ball through the tool string to switch the downhole cutting tool to the second position.

19. The method of operating a downhole cutting tool and a hydraulically actuated downhole tool on a single downhole trip according to claim 16 wherein the method comprises rotating the downhole cutting tool by rotating the tool string whilst the knives are deployed to cut the casing.

20. The method of operating a downhole cutting tool according to claim 16 wherein the hydraulically actuated downhole tool is a drill and actuation of the drill is used to dress-off a cement plug prior to cutting the casing.

* * * * *